US006744203B2

(12) United States Patent
Jeong et al.

(10) Patent No.: US 6,744,203 B2
(45) Date of Patent: Jun. 1, 2004

(54) PLASMA DISPLAY PANEL HAVING REDUCED ADDRESSING TIME AND INCREASED SUSTAINING DISCHARGE TIME

(75) Inventors: Jae-Seok Jeong, Asan (KR); Dae-Young Hong, Pyungtaek (KR)

(73) Assignee: Samsung SDI Co., Ltd., Suwon-si (KR)

( * ) Notice: Subject to any disclaimer, the term of this patent is extended or adjusted under 35 U.S.C. 154(b) by 68 days.

(21) Appl. No.: 10/095,471

(22) Filed: Mar. 13, 2002

(65) Prior Publication Data

US 2002/0130621 A1 Sep. 19, 2002

(30) Foreign Application Priority Data

Mar. 13, 2001 (KR) ..... 2001/12892

(51) Int. Cl.[7] ..... H01J 17/49; G09G 3/10

(52) U.S. Cl. ..... 313/587; 313/583; 313/586; 313/495; 315/169.4

(58) Field of Search ..... 313/582–587; 315/169.4, 169.1; 430/316

(56) References Cited

U.S. PATENT DOCUMENTS 5,061,876 A * 10/1991 Park ..... 313/581
5,686,790 A * 11/1997 Curtin et al. ..... 313/493
5,914,563 A * 6/1999 Lee et al. ..... 313/585
5,952,782 A * 9/1999 Nanto et al. ..... 313/584
5,962,974 A * 10/1999 Komaki et al. ..... 313/582
5,967,872 A 10/1999 Betsui et al.
6,043,605 A * 3/2000 Park ..... 313/586
6,218,784 B1 * 4/2001 Jang et al. ..... 315/169.1
6,229,261 B1 * 5/2001 Kim ..... 313/586
6,329,752 B1 * 12/2001 Choi ..... 313/585
6,373,452 B1 * 4/2002 Ishii et al. ..... 345/67
6,577,057 B1 * 6/2003 Yamamoto et al. ..... 313/495

FOREIGN PATENT DOCUMENTS

| | | |
|---|---|---|
| JP | 10-240188 | 9/1998 |
| KR | P1998-072077 | 10/1998 |
| KR | P2001-0004170 | 1/2001 |

OTHER PUBLICATIONS

"Notice to Submit response" issued by Korean Intellectual Property Office dated on Feb. 25, 2003.

* cited by examiner

*Primary Examiner*—Nimeshkumar D. Patel
*Assistant Examiner*—German Colón
(74) *Attorney, Agent, or Firm*—Robert E. Bushnell, Esq.

(57) ABSTRACT

A plasma display panel including a substrate having via holes, partitions spaced a predetermined distance apart on the substrate, address electrodes having a predetermined pattern on portions of the substrate between adjacent pairs of the partitions, each address electrode being split into at least three parts with each split part corresponding to two pixels, a first dielectric layer on the substrate to cover the address electrodes and where the via holes correspond to the address electrodes, a conductive layer in the via holes and electrically connected with the address electrodes, terminals connected to the conductive layer on the rear surface of the substrate, a transparent front plate disposed opposite the substrate, sustaining electrodes on the front plate at a predetermined angle with respect to a direction of the address electrodes, the sustaining electrodes comprising pairs of first and second electrodes, and a second dielectric layer on the front plate to cover the sustaining electrodes.

16 Claims, 4 Drawing Sheets

PLASMA DISPLAY PANEL HAVING REDUCED ADDRESSING TIME AND INCREASED SUSTAINING DISCHARGE TIME

CLAIM OF PRIORITY

This application makes reference to, incorporates the same herein, and claims all benefits accruing under 35 U.S. C. §119 from an application for PLASMA DISPLAY DEVICE earlier filed in the Korean Industrial Property Office on Mar. 13, 2001, and there duly assigned Ser. No. 12892/2001 by that Office.

BACKGROUND OF THE INVENTION

1. Technical Field

The present invention relates to a plasma display panel (PDP) and, more particularly, to a plasma display panel having improved address electrodes.

2. Related Art

A plasma display panel generates light by exciting fluorescent materials or special discharge gases. A predetermined voltage is applied between two electrodes to cause a discharge, and a fluorescent layer is excited by ultraviolet light generated by the discharge, thereby forming a picture image.

A plasma display panel is a thin display device that can display images rapidly and that can allow for a large screen size. Plasma display devices can be divided into direct current (DC) plasma display devices and alternating current (AC) plasma display devices according to their operating principles. Also, depending on the electrode structure, the plasma display device has two or three electrodes for discharge. In the direct current plasma display device, an auxiliary anode is additively installed to induce an auxiliary discharge. In the alternating current plasma display device, an address electrode is introduced to separately provide a selective discharge and a sustaining discharge to enhance addressing speed.

Also, the electrode structure of the alternating current plasma display device can be classified into an opposing electrode structure and a surface-discharge type electrode structure, according to the arrangement of discharge-inducing electrodes. In the former case, two discharge-inducing sustaining electrodes are disposed on a front substrate and a rear substrate, respectively, so that a discharge takes place in a direction perpendicular to the panel. In the latter case, two sustaining electrodes are disposed on a substrate so that a discharge takes place along the substrate.

One problem that can occur in a plasma display panel is the lack of ability to attain sufficient brightness. That problem can occur if there is a large quantity of scanning electrodes. Also, in a plasma display panel, some arrangements of electrode elements and throughholes can make mass production difficult We have found that it would be desirable to have improved address electrodes for a plasma display panel.

Exemplars of recent efforts in the art include U.S. Pat. No. 5,967,872 for METHOD FOR FABRICATION OF A PLASMA DISPLAY PANEL issued to Betsui et al. on Oct. 19, 1999 and Japanese Patent Publication No. hei 10-240188 for PICTURE DISPLAY DEVICE AS PICTURE DISPLAY METHOD issued to Yamazaki et al. on Sep. 11, 1998.

While these recent efforts provide advantages, we note that they fail to adequately and conveniently provide improved address electrodes for a plasma display panel

SUMMARY OF THE INVENTION

To solve the above disadvantages and problems, and other problems, it is an object of the present invention to provide a plasma display panel in which a plurality of sub-fields can be designed within one field to reduce pseudo details by reducing addressing time and increasing sustaining discharge time by dividing an address electrode into a plurality of parts.

It is another object of the present invention to provide a plasma display panel to increase the design margin of a driving method thereof by reducing addressing time. In a plasma display panel, an addressing time for the respective sub-fields within the period of one frame occupies approximately 70% of the entire driving time of one frame, while resetting or sustain discharging takes place for the remaining time period, that is, 30% of the entire driving time. Thus, there are some limits in increasing the number of sub-fields or designing the arrangement of sub-fields in various manners. However, according to the principles of the present invention, since the addressing time is reduced, various arrangements of sub-fields can be designed within the period for one frame and the number of sub-fields can be increased. The phrase "design margin" used in the Specification means the amount of freedom available in designing a plasma display panel. In other words, the design margin is the area within the design limits. Accordingly, a wider design margin means that a plasma display panel is less restricted in terms of design.

Additional objects and advantages of the invention will be set forth in part in the description which follows and, in part, will be obvious from the description, or may be learned by practice of the invention.

To accomplish the above and other objects, a plasma display panel according to an embodiment of the present invention includes a substrate, partitions spaced a predetermined distance apart from each other on the substrate, address electrodes having a predetermined pattern formed on portions of the substrate between each of the partitions, each address electrode being split into at least three parts with each split part corresponding to at least two pixels, a first dielectric layer formed on the substrate to cover the address electrodes, via holes formed on portions of the substrate corresponding to the respective address electrodes, a conductive layer formed in the via holes electrically connected with the address electrodes, terminals connected to the conductive layer and formed on a rear surface of the substrate, a transparent front plate disposed opposite the substrate, a plurality of sustaining electrodes formed in a direction on the front plate opposite the substrate at a predetermined angle with respect to a direction of the address electrodes and having pairs of first and second electrodes, and a second dielectric layer installed on the front plate to cover the sustaining electrodes.

According to an aspect of the present invention, a plasma display panel further includes a printed circuit board (PCB) having supply terminals contacting the terminals on the rear surface of the substrate, the supply terminals corresponding to the terminals of the address electrodes.

According to another embodiment of the present invention, a plasma display panel includes a substrate, partitions spaced a predetermined distance apart from each other on the substrate, address electrodes having a predetermined pattern formed on portions of the substrate between adjacent pairs of the partitions, each address electrode being split into at least three parts with each split part corresponding to at least two pixels, a first dielectric layer formed on the substrate to cover the address electrodes, an insulation layer formed between the address electrodes and the substrate, a voltage supplying unit positioned on a lower surface of the insulation layer to apply a predetermined voltage to corresponding ones of the address electrodes, a transparent front plate disposed opposite the substrate, a plurality of sustaining electrodes formed on the front plate opposite to the substrate at a predetermined angle with respect to the direction of address electrodes and having pairs of first and second electrodes, and a second dielectric layer installed on the front plate to cover the sustaining electrodes.

According to another aspect of the present invention, the voltage supplying unit includes via holes formed on portions of the dielectric layer corresponding to each of the address electrodes, a conductive layer formed in the via holes and electrically connected with the address electrodes, and an interconnection layer formed between the insulation layer and the substrate in a predetermined pattern to be electrically connected to the conductive layer.

The present invention is more specifically described in the following paragraphs by reference to the drawings attached only by way of example. Other advantages and features will become apparent from the following description and from the claims.

BRIEF DESCRIPTION OF ERIE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

Figure 1:
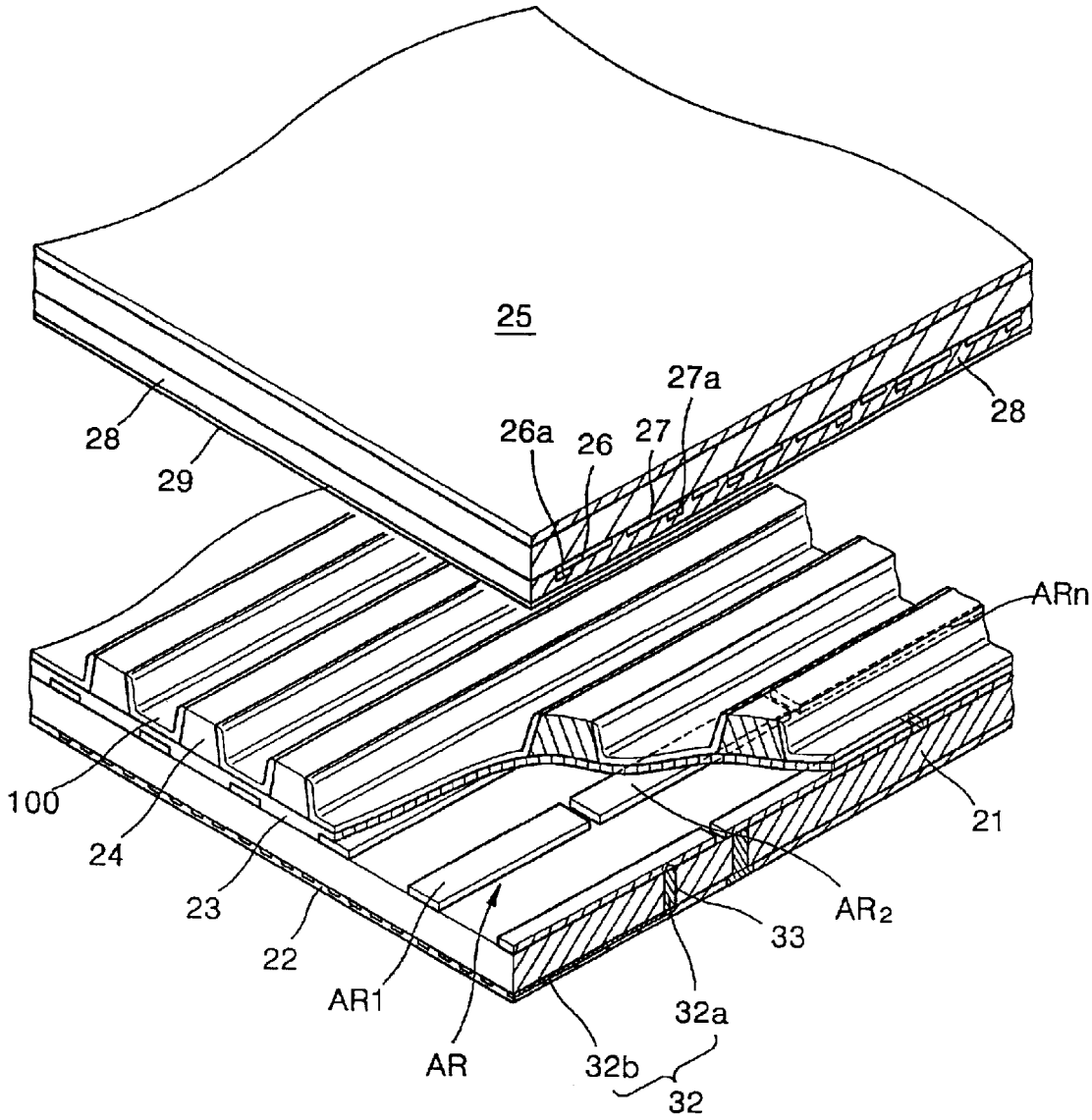
FIG. 1 is an exploded perspective view of a first embodiment of a plasma display panel, in accordance with the principles of the present invention.

While the present invention will be described more full hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being abroad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, the embodiments disclosed can be combined.

The electrode structure of an alternating current plasma display device can be classified into an opposing electrode structure and a surface-discharge type electrode structure, according to the arrangement of discharge-inducing electrodes. In the former case, two discharge-inducing sustaining electrodes are disposed on a front substrate and a rear substrate, respectively, so that a discharge takes place in a direction perpendicular to the panel. In the latter case, two sustaining electrodes are disposed on a substrate so that a discharge takes place along the substrate.

In the surface discharge type plasma display panel, a dielectric layer having address electrodes embedded therein is formed on the upper surface of a substrate, and partitions having a predetermined pattern for defining discharge spaces are formed on an upper surface of the dielectric layer. The substrate having the partitions is bonded to a front plate. Common electrodes and scanning electrodes are formed on a lower surface of the front plate. A dielectric layer having the common electrodes and the scanning electrodes embedded therein and a protective layer made of magnesium oxide (MgO) coated on a lower surface of the dielectric layer are formed on the lower surface of the front plate. Also, a fluorescent layer is formed on the upper surface of the dielectric layer between adjacent pairs of the partitions.

In the operation of the plasma display device having the above structure, when a predetermined voltage is applied to the respective address electrodes, common electrodes, and scanning electrodes, wall charges are accumulated in discharge spaces by a trigger discharge caused by the address electrodes and the sustaining electrodes. A discharge occurs in the discharge spaces filled with the wall charges, between the common electrodes and the sustaining electrodes, thereby producing ultraviolet light. Then, the fluorescent layer is excited by the ultraviolet light, thereby forming a picture image.

In the above-described plasma display device, since the address electrodes embedded in the dielectric layer between adjacent pairs of partitions are formed in a striped pattern, the time necessary for addressing the striped address electrodes depends on the number of the sustaining electrodes associated with the address electrodes. Thus, the fewer the sustaining electrodes, the longer the sustaining discharge time becomes.

Taking the above into account, there could be proposed an address electrode structure that can reduce the sustaining discharge time. Each address electrode is divided into two parts at the center of an effective screen of a plasma display device. However, even with such an address electrode structure, if there are many scanning electrodes, sufficient brightness cannot be attained Another example of an image display device for reducing addressing time and a display method thereof can be described as follows. A plurality of pixels are arranged on a panel substrate. That is to say, the disclosed device includes pairs of electrode elements which are arranged to intersect scanning lines and in which a priming discharge, an erasure discharge, a writing discharge and a sustaining discharge are carried out with respect to a series of pixels on the scanning electrodes. A plurality of electrodes arranged to intersect the pairs of electrode elements. Recording electrodes, which correspond to the respective pixels are arranged on one surface of the panel substrate and are electrically connected to each other at opposite sides of the panel substrate. The recording electrodes perform recording discharges of the respective pixels in cooperation with the electrode elements. In the image display device, the electrode elements must be arranged at the respective cells in a direction crossing the scanning lines. This arrangement makes mass production difficult.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
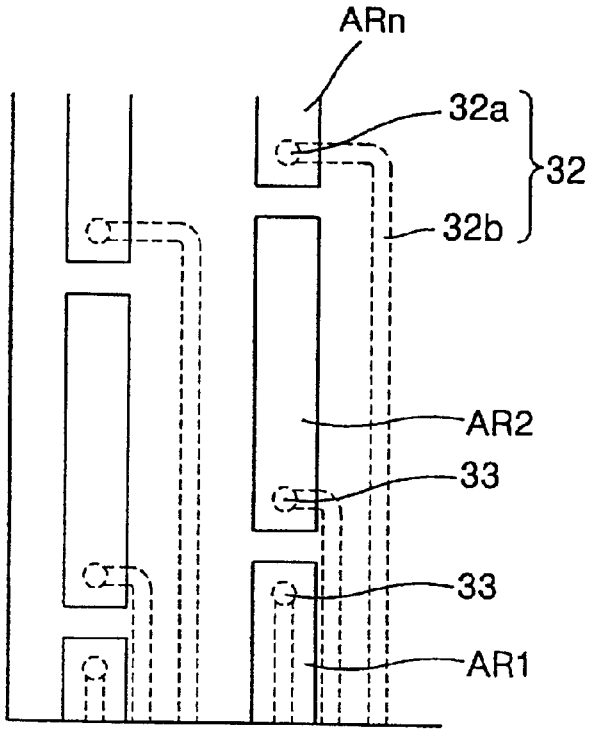
FIG. 2 is a plan view showing the arrangement of the address electrodes of FIG. 1.
Figure 3:
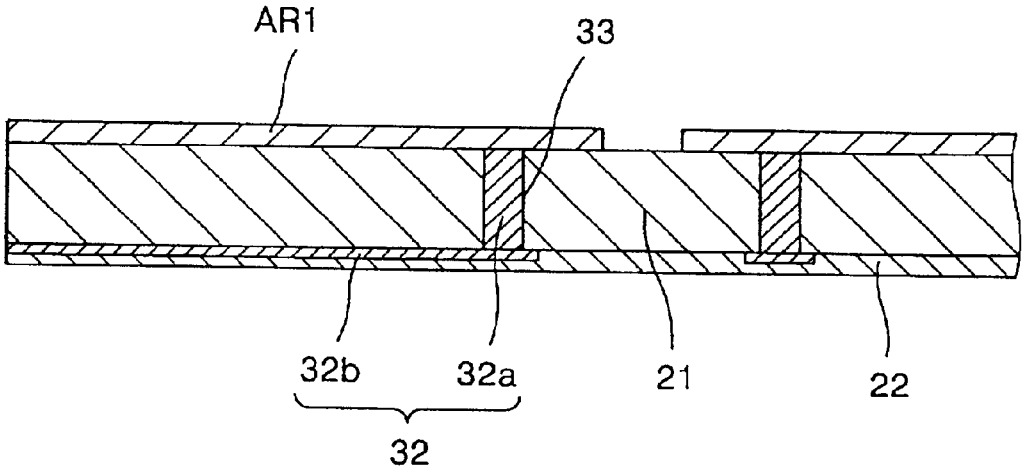
FIG. 3 is a cross-sectional view of the substrate shown in FIG. 1.

FIG. 1 is an exploded perspective view of a first embodiment of a plasma display panel, in accordance with the principles of the present invention. FIG. 2 is a plan view showing the arrangement of the address electrodes of FIG. 1. FIG. 3 is a cross-sectional view of the substrate shown in FIG. 1.

FIGS. 1 through 3 show a plasma display panel (PDP) according to an embodiment of the present invention. Address electrode lines AR have a predetermined pattern and are formed on an upper surface of a substrate 21. Each of the address electrode lines AR is split into at least three parts AR1–ARn lengthwise. Each of the split address electrode parts AR1–ARn has a length corresponding to at least two pixels. A predetermined current is applied to the split address electrode parts AR1–ARn by a voltage supplying unit.

The voltage supplying unit includes via holes 33 formed on areas of the substrate 21 corresponding to the respective split address electrode parts AR1–ARn, and an interconnection layer 32 to supply a voltage to the respective split address electrode parts AR1–ARn through the via holes 33. The interconnection layer 32 includes conductive connecting portions 32*a* filled within the via holes 33 formed on the substrate 21, and signal lines 32*b* having a predetermined pattern connected with the respective conductive connecting portions 32*a* and formed on the lower surface of the substrate 21. Here, an insulation layer 22 is formed on a lower surface of the substrate 21 having the interconnection layer 32.

Figure 4:
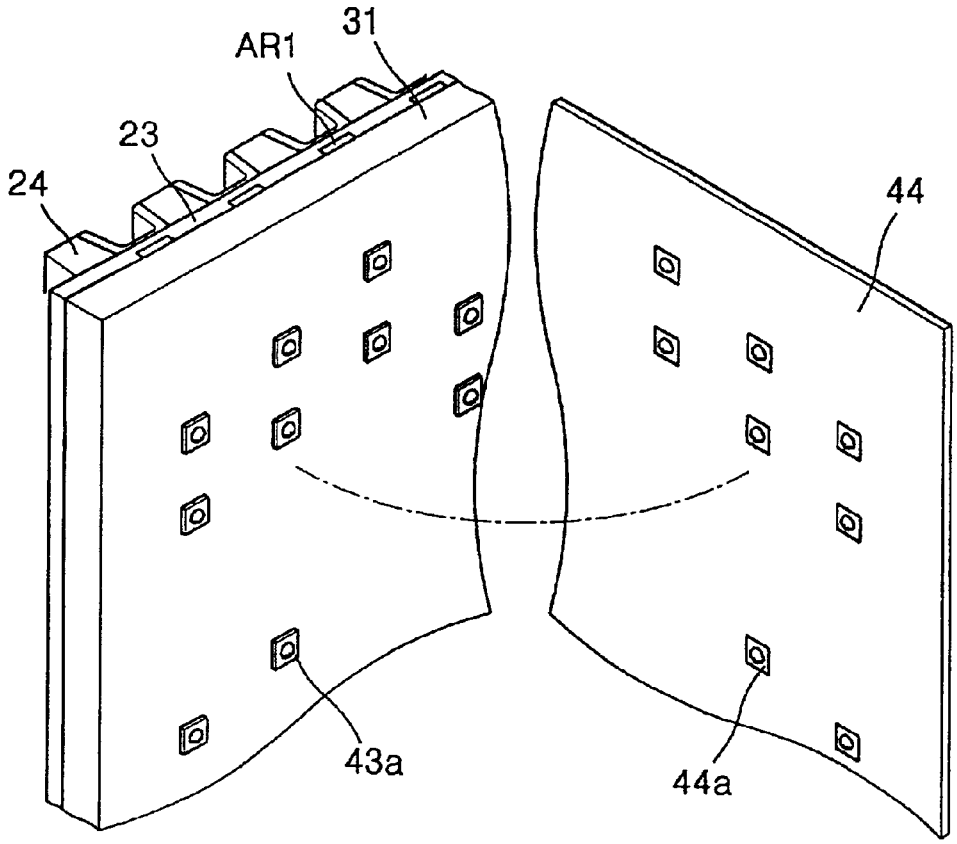
FIG. 4 is an exploded perspective view of a second embodiment of a plasma display panel, in accordance with the principles of the present invention.
Figure 5:
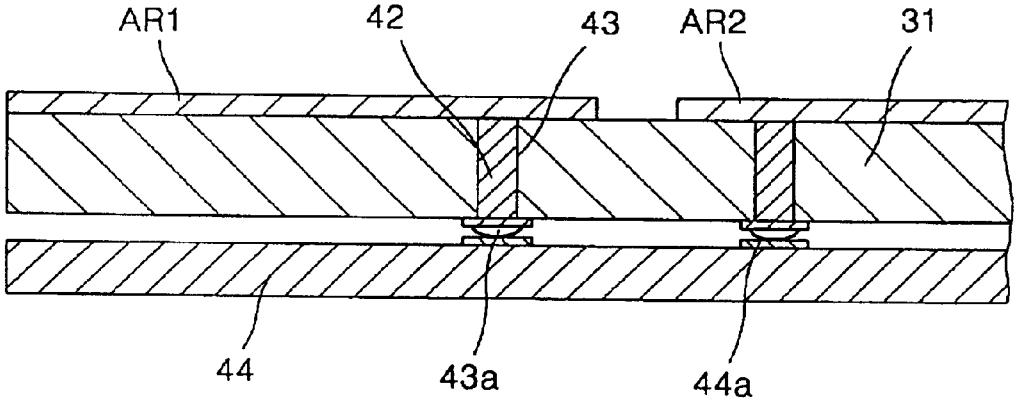
FIG. 5 is a cross-sectional view of the substrate shown in FIG. 4.

FIG.4 is an exploded perspective view of a second embodiment of a plasma display panel, in accordance with the principles of the present invention. FIG. 5 is a cross-sectional view of the substrate shown in FIG. 4.

As shown in FIGS. 4 and 5, the voltage supplying unit according to another embodiment of the present invention includes via holes 43 formed on a substrate 31 corresponding to the split address electrode parts AR1–ARn. Connecting portions 42 filled with conductive materials are formed in the via holes 43. Terminal patterns 43*a* connected to the respective connecting portions 42 are formed on a rear surface of the substrate 31 having the via holes 43. The terminal patterns 43*a* contact main terminal patterns 44*a* on a printed circuit board (PCB) 44 that is sealed with the substrate 31. Here, the main terminal patterns 44*a* are arranged on one surface of the PCB 44 in a same pattern as the terminal patterns 43*a*.

Referring to FIG. 1, a first dielectric layer 23 is formed on the substrate 21 having the split address electrode parts AR1–ARn, and partitions 24 having a predetermined pattern are formed on the first dielectric layer 23. The partitions 24 are formed in a striped pattern in a direction parallel to each other. However, the pattern can be without any limitation in their shape, and can be formed in a matrix or snaking pattern. The matrix pattern refers to the partitions being arranged in straight overlapping columns and rows. The snaking pattern refers to the partitions being arranged in a sinuous or undulating pattern.

As described above, the substrate 21 having the split address electrode parts AR1–ARn and the partitions 24 is sealed with the transparent front plate 25 to hermetically seal discharge spaces defined by the partitions 24. First electrodes 26 and second electrodes 27, which are sustaining electrodes, are formed on a lower surface of the front plate 25 orthogonally to the direction of the split address electrode parts AR1–ARn. The first and second electrodes 26 and 27 are covered by a second dielectric layer 28 formed on the front plate 25. The first and second electrodes 26 and 27 are transparent electrodes made of indium tin oxide (ITO), each having a predetermined width and corresponding bus electrodes 26*a* and 27*a* made of a metal. Each bus electrode 26*a* has a width smaller than that of the corresponding transparent electrode 26. Each bus electrode 27*a* has a width smaller than that of the corresponding transparent electrode 27. The first and second electrodes 26 and 27 are not limited to those shown in the above-described embodiment and can be modified in various forms. For example, the first and second electrodes 26 and 27 may include at least two strip-like metal electrodes spaced apart from each other. A phosphor layer 100 is formed on the inner surfaces of discharge spaces defined between each adjacent pair of the partitions 24. The electrode parts AR1–ARn are located adjacent to, and near to, the discharge spaces, as shown in FIG. 1. A protective film 29 made of magnesium oxide (MgO) is disposed over the second dielectric layer 28.

The plasma display panel having the aforementioned configuration is driven by applying a voltage to the respective electrodes using an address/display separation (ADS) driving method. An address/display separation (ADS) driving method is a method in which reset and address steps are performed for all scan electrode lines within a unit sub-field during a certain period and then a display discharge step is separately performed. That is, an addressing period and a sustaining discharge period are separated.

In the address driving method, while display data signals are applied to the split address electrode parts AR1–ARn, scan pulses are sequentially applied to the second electrodes 27. The display data signals applied to the address electrode parts AR1–ARn are positive polarity voltages when a discharge cell is selected, and a ground voltage otherwise. The ground voltage is 0 volts (V), for the purpose of this description. A positive polarity bias voltage is applied to the second electrodes 27 during a non-scanning period, and 0 V during a scanning period. Accordingly, while the scan pulse 0 volts is applied to the second electrodes 27, if the positive polarity voltage is applied to at least one split address electrode AR1–ARn, wall charges are formed at the corresponding discharge cells. While the scan pulse of 0 volts is applied to the second electrodes 27, if the ground voltage, that is, 0 volts, is applied to at least one split address electrode AR1–ARn, no wall charges are formed at the corresponding discharge cells. If a voltage greater than or equal to a predetermined level is applied to selected discharge cells, wall charges are formed by address discharging. However, if a voltage less than the predetermined level is applied to unselected discharge cells, address discharging does not take place so that no wall charges are formed.

During address driving, the split address electrode parts AR1–ARn greatly reduce addressing time. In particular, in the above-mentioned address/display separation (ADS) driving method, the proportion of the addressing time for one frame is substantially 70% of the entire driving time. Here, since there are at least three split address electrode parts AR1–ARn, the addressing time can be divided by the number of split electrode parts AR1–ARn. In such a manner, while reducing the addressing time, the sustaining discharge time can be greatly increased.

In surface-discharge type plasma display panels, each address electrode has one or two lines since addressing takes up approximately 70% of the total driving time for one frame, the remaining time is assigned a sustaining discharge. In the present invention, each address electrode is split into N parts, and N address and scan pulses are simultaneously applied to N split address electrode lines to perform an address discharge. Thus, as N increases, the time required for addressing is reduced. In the ADS driving method of the present invention, the sustaining discharge time is increased by the amount by which the addressing time is reduced.

As described above, since the time obtained as a result offering the addressing time can be utilized in sustain driving, high luminance display can be achieved by the increased sustaining discharge time. Also, additional sub-fields can be interleaved for reduction of moving picture false contour. The term 'moving picture false contour' describes the distortion of a moving picture contour occurring in the case of displaying the moving picture in a time-divisional display manner. That is, a black or white line is viewed on a screen by the action of unselected sub-fields. If the number of sub-fields in one frame is further increased, the action of unselected sub-fields can be reduced, thereby relatively suppressing the occurrence of the moving picture false contour effect. Thus, in order to reduce the moving picture false contour effect, additional sub-fields can be interleaved.

In the sustaining driving, a common pulse of a voltage higher than the positive polarity voltage is alternately applied to all the second electrodes 27 and the first electrodes 26, thereby causing display discharges at the discharge cells having the formed wall charges formed therein during addressing periods.

Figure 6:
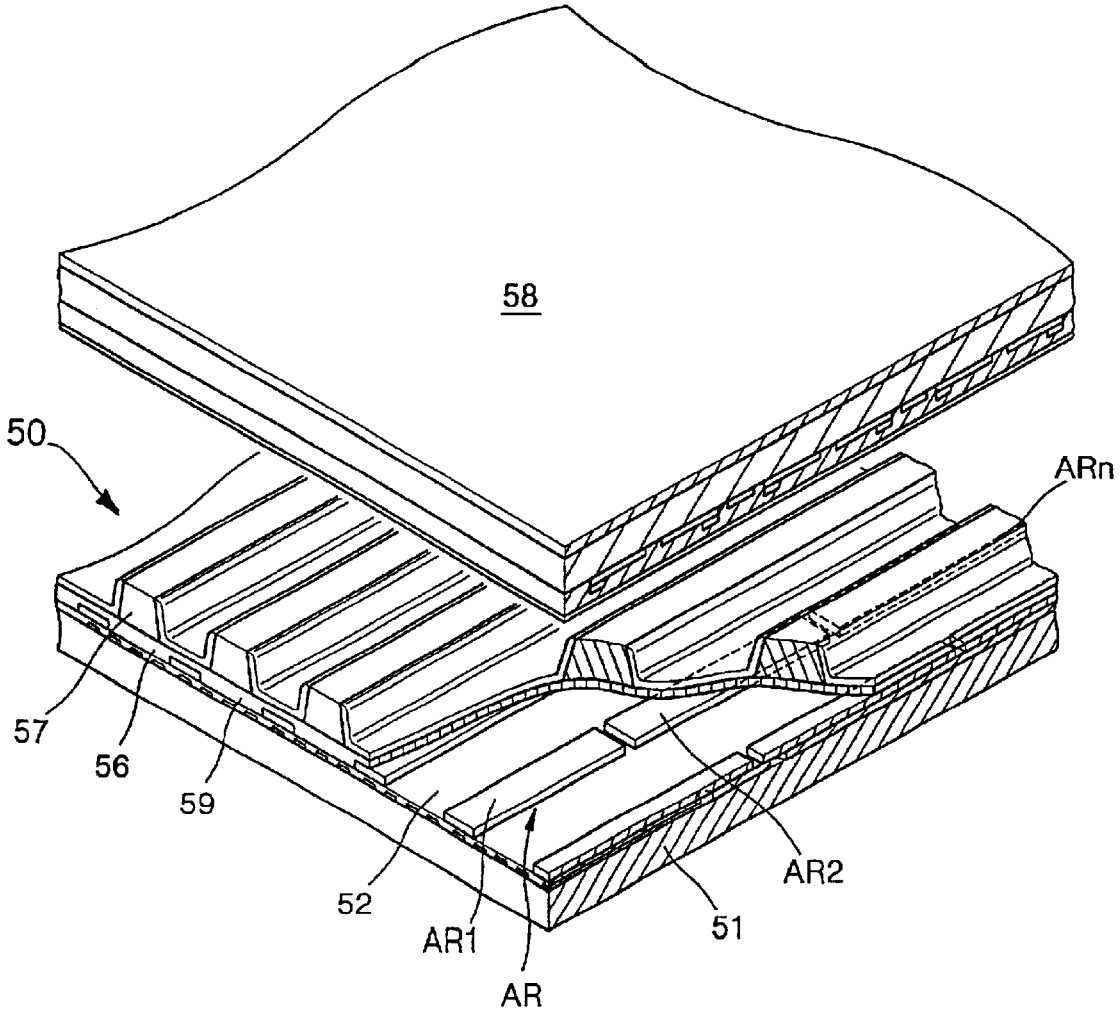
FIG. 6 is an exploded perspective view of a third embodiment of a plasma display panel, in accordance with the principles of the present invention.
Figure 7:
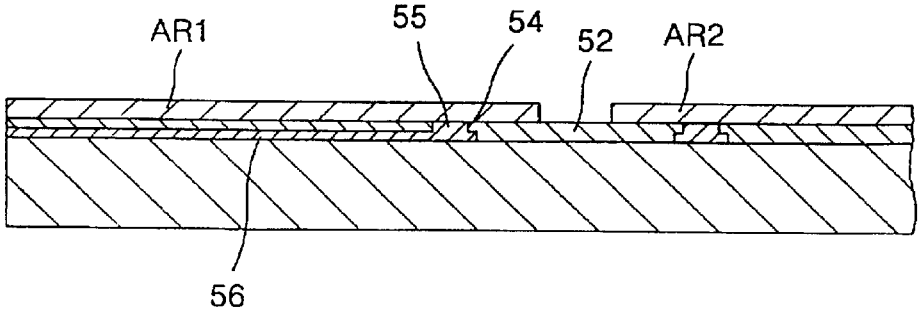
FIG. 7 is a plan view showing the arrangement of the address electrodes of FIG. 6.

FIG. 6 is an exploded perspective view of a third embodiment of a plasma display panel, in accordance with the principles of the present invention. FIG. 7 is a plan view showing the arrangement of the address electrodes of FIG. 6. The FIGS. 6 and 7 show a plasma display panel 50 according to a third embodiment of the present invention.

As shown in FIGS. 6 and 7, the plasma display panel 50 includes an insulation layer 52 on an upper surface of a substrate 51, and address electrode lines AR having a predetermined pattern formed on the insulation layer 52. The address electrode lines AR each have at least three split address electrode parts AR1–ARn as in the above-described embodiment of FIG. 1. A voltage supplying unit applies a predetermined voltage to the split address electrode parts AR1–ARn and is installed on the insulation layer 52. The voltage supplying unit includes via holes 54 formed on a portion of the insulation layer 52 corresponding to the split address electrodes AR1–ARn. The via holes 54 are filled with a conductive material to form connecting portions 55, which are connected to predetermined interconnection layers 56 formed on the upper surface of the substrate 51 under the insulation layer 52. A first dielectric layer 59, with which the address electrode lines AR are covered, is formed on the insulation layer 52.

The insulation layer 52 comprises a green sheet. The address electrode lines AR are formed on an upper surface of insulation layer 52. The voltage supplying unit, having connecting portions 55 and interconnection layer 56, is formed on a lower surface of insulation layer 52. In other words, the insulation layer 52, the interconnection layer 56 and split address electrode parts AR1–ARn are in the form of a sheet that is adhered to the upper surface of the substrate 51. In this case, an adhesion layer is formed on a lower surface of the insulation layer 52 to attach the insulation layer 52 to the substrate 51. As described above, the first dielectric layer 59, which covers the address electrode lines AR, is formed on the insulation layer 52. Partitions 57 are formed between adjacent pairs of the address electrode lines AR on the first dielectric layer 59.

The substrate 51 having the partitions 57 is connected to a front plate 58. The construction of the front plate 58 includes first and second electrodes 26 and 27, a second dielectric layer 28 and a protective film 29 in the same manner as described with reference to FIG. 1. The operation of the plasma display panel having the configuration and operation of FIGS. 6 and 7 is the same as described above with reference to FIG. 1.

As described above, in the plasma display panel according to the present invention, each of the address electrode lines is divided into at least three split address electrode parts, which are simultaneously driven, thereby reducing addressing time.

According to an experiment performed by the present inventors, in driving a 852×480 plasma display panel of an eight-bit gray scale by an address/display separation (ADS) method, in the case where each of the address electrodes is not split lengthwise, the proportion of an address driving period to a sustain driving period was approximately 10:6. However, in the case where each of the address electrodes is split into four parts lengthwise, the proportion of an address driving period to a sustain driving period was approximately 3:13. For the two cases, the relative ratio of brightness related to sustain driving was 13:6. Thus, the brightness for the case of driving split address electrodes was approximately 2.17 (13/6) times greater than the case of not splitting the address electrodes.

While the present invention has been illustrated by the description of embodiments thereof, and while the embedments have been described in considerable detail, it is not the intention of the applicant to restrict or in any way limit the scope of the appended claims to such detain Additional advantages and modifications will readily appear to those skilled in the art. Therefore, the invention in its broader aspects is not limited to the specific details, representative apparatus and method, and illustrative examples shown and described. According, departures may be made from such details without departing from the spirit or scope of the applicant's general inventive concept.

What is claimed is:

1. A plasma display panel, comprising:

a substrate forming a plurality of holes, and having a front surface and a rear surface;

a plurality of partitions spaced apart from each other on said front surface of said substrate;

a plurality of address electrodes formed on said front surface of said substrate between adjacent ones of said partitions, said plurality of address electrodes having a predetermined pattern, each one of said address electrodes being divided into at least three parts, each one of said parts of said address electrodes having a size corresponding to a size of at least two pixels, each one of the holes having a location corresponding to a location of a respective one of said parts of said address electrodes;

a first dielectric layer covering said address electrodes, said first dielectric layer being disposed on said front surface of said substrate between said substrate and said partitions;

a plurality of conductive portions located in the holes and electrically connected to said address electrodes;

a plurality of first terminals formed on said rear surface of said substrate, each one of said first terminals connecting to one of said conductive portions;

a transparent front plate disposed adjacent to said front surface of said substrate;

a plurality of sustaining electrodes formed on said front plate and aligned in a direction to form a predetermined angle with said address electrodes, each one of said sustaining electrodes including a pair of first and second electrodes;

a second dielectric layer being installed on said front plate and covering said sustaining electrodes; and an interconnection layer connected to said first terminals on said rear surface of said substrate.

2. The plasma display panel of claim 1, further comprising a printed circuit board having supply terminals contacting said first terminals.

3. A plasma display panel, comprising:

a substrate;

a plurality of partitions spaced a predetermined distance apart from each other on said substrate;

a plurality of address electrodes having a predetermined pattern formed on portions of said substrate between adjacent ones of said partitions, each one of said address electrodes being divided into at least three parts, each of said parts of said address electrodes having a size corresponding to a size of at least two pixels;

a first dielectric layer formed on said substrate to cover said address electrodes;

an insulation layer formed between said address electrodes and said substrate, said insulation layer having an upper surface contacting said address electrodes and having a lower surface;

a voltage supplying unit positioned on said lower surface of said insulation layer to apply predetermined voltages to respective ones of said address electrodes;

a transparent front plate disposed opposite said substrate;

a plurality of sustaining electrodes formed on said front plate and arranged to form a predetermined angle with said address electrodes, each one of said sustaining electrodes including a pair of first and second electrodes; and a second dielectric layer installed on said front plate to cover said sustaining electrodes;

said voltage supplying unit comprising an interconnection layer formed between said insulation layer and said substrate in a predetermined pattern.

4. The plasma display panel of claim 3, said voltage supplying unit further comprising:

a conductive layer formed in a plurality of holes, the holes being formed in said insulation layer, each one of the holes having a location corresponding to a location of a respective one of said parts of said address electrodes, said conductive layer being electrically connected with said address electrodes;

said interconnection layer being electrically connected with said conductive layer.

5. The plasma display panel of claim 4, said insulation layer comprising a green sheet, said voltage supplying unit and said address electrodes being formed on said green sheet.

6. The plasma display panel of claim 5, further comprising an adhesion layer formed on a surface of said green sheet.

7. An apparatus, comprising:

a substrate forming a plurality of via holes, and having a front surface and a rear surface;

a plurality of address electrodes being formed on said front surface of said substrate, said plurality of address electrodes having a predetermined pattern, each one of said address electrodes being divided into at least three parts, each one of the via holes having a location corresponding to a location of a respective one of said parts of said address electrodes;

a first dielectric layer covering said address electrodes, said first dielectric layer being disposed on said front surface of said substrate;

a plurality of conductive portions located in the via holes and electrically connecting with said parts of said address electrodes;

a plurality of conductive units electrically connected to said conductive portions;

a transparent front plate disposed adjacent to said front surface of said substrate;

a plurality of sustaining electrodes formed on said front plate and aligned in a direction to form a predetermined angle with said address electrodes;

a second dielectric layer installed on said front plate and covering said sustaining electrodes; and an interconnection layer formed adjacent to said substrate and electrically connected to said conductive portions.

8. The apparatus of claim 7, each one of said sustaining electrodes including a first electrode and a second electrode.

9. The apparatus of claim 8, further comprising a protective film mounted to said second dielectric layer.

10. The apparatus of claim 9, further comprising a plurality of partitions formed on said first dielectric layer between adjacent ones of said address electrodes.

11. The apparatus of claim 10, further comprising a phosphor layer located between adjacent ones of said partitions.

12. The apparatus of claim 11, said partitions being arranged to extend in a first direction, said sustaining electrodes being arranged to extend in a second direction perpendicular to said first direction.

13. The apparatus of claim 8, said first electrode further comprising a bus electrode, said bus electrode having a length approximately equal to a length of said first electrode, said bus electrode having a width smaller than a width of said first electrode.

14. The apparatus of claim 13, said sustaining electrodes including indium tin oxide, and said bus electrode including a metal.

15. The apparatus of claim 13, further comprising a printed circuit board having a plurality of main terminals, said printed circuit board being arranged opposite said rear surface of said substrate, said conductive units corresponding to first terminals, said first terminals electrically connecting with said main terminals.

16. The apparatus of claim 13, said conductive units corresponding to signal lines, said signal lines providing predetermined current to said address electrodes.

* * * * *